Best Available Copy

United States Patent [19]

Ogawa

[11] Patent Number: 4,490,124

[45] Date of Patent: Dec. 25, 1984

[54] RUNNING TOY

[75] Inventor: Iwakichi Ogawa, Kashiwa, Japan

[73] Assignee: Takara Co., Ltd., Tokyo, Japan

[21] Appl. No.: 492,999

[22] Filed: May 9, 1983

[30] Foreign Application Priority Data

Sep. 30, 1982 [JP] Japan ..... 57-148146

[51] Int. Cl.[3] ..... A63H 29/00

[52] U.S. Cl. ..... 446/464; 446/465

[58] Field of Search ..... 46/211, 206, 209, 201, 46/251, 129, 202, 208, 249, 252; 446/431, 441, 464, 465, 462

[56] References Cited

U.S. PATENT DOCUMENTS

| | | | |
|---|---|---|---|
| 1,989,732 | 2/1935 | Barrett | 46/129 UX |
| 3,000,137 | 9/1961 | Vine | 46/211 |
| 3,540,152 | 8/1968 | Beny et al. | 46/206 |
| 3,816,958 | 6/1974 | Winston | 46/211 |
| 3,892,086 | 7/1975 | Gay et al. | 46/202 |
| 4,300,308 | 11/1981 | Ikeda | 46/206 |
| 4,363,187 | 12/1982 | Shinohara | 46/211 |

FOREIGN PATENT DOCUMENTS

| | | | |
|---|---|---|---|
| 665971 | 10/1938 | Fed. Rep. of Germany | 46/208 |

*Primary Examiner*—F. Barry Shay

*Attorney, Agent, or Firm*—Jackson, Jones & Price

[57] ABSTRACT

The invention relates to a running toy having a self-contained motor assembly. The running toy is provided with a pivoting member and a mechanism by which it is actuated in response to the motion of part of the motor assembly to make the running toy somersault when the running toy is traveling along a support surface. The somersault may be rearward or forward. The pivoting member may be manually locked so that the motor will not actuate it.

5 Claims, 15 Drawing Figures

RUNNING TOY

BACKGROUND OF THE INVENTION

The present invention relates to a running toy and more particularly to a miniature, lightweight running toy.

Hitherto, a large variety of running toys have been available on the toy market. Generally speaking, these running toys appeal to children not only by their appearances, but also by their running modes. These running toys, however, usually only have the running modes of forward movement, backward movement, turning right and turning left. In consequence, the toy industry has been longing for the appearance of a running toy which is more interesting to children.

SUMMARY OF THE INVENTION

Accordingly, a primary object of the invention is to provide a running toy having a unique running mode in that while it is travelling along a support surface, the running toy is able to somersault and then continue its forward movement along the support surface as before.

Generally speaking, in accordance with the present invention, there is provided a somersault-action running toy. The somersault-action running toy comprises a housing member, a front wheel assembly attached to the housing member, a rear wheel assembly attached to the housing member, a self-contained motor assembly attached to the housing member to drive the running toy, and a mechanism actuated in response to the motion of part of the motor assembly to make the running toy somersault when the running toy is travelling along a support surface.

The invention accordingly comprises the features of construction, combination of elements, and arrangement of parts which will be exemplified in the construction hereinafter set forth, and the scope of the invention is set forth in the claims appended hereto.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

The invention will be described hereinafter in detail through embodiments of the invention shown in the accompanying drawings.

Figure 1:
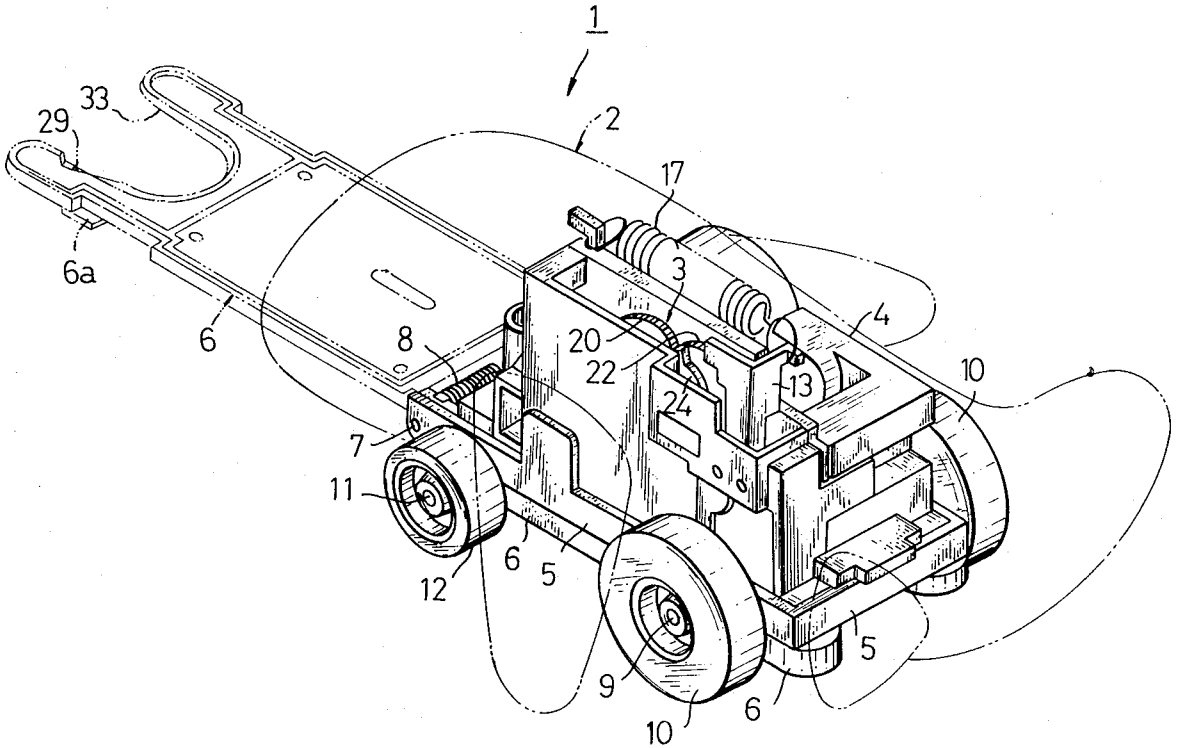
FIG. 1 is a perspective view showing the internal structure of a running toy in accordance with an embodiment of the invention.
Figure 4:
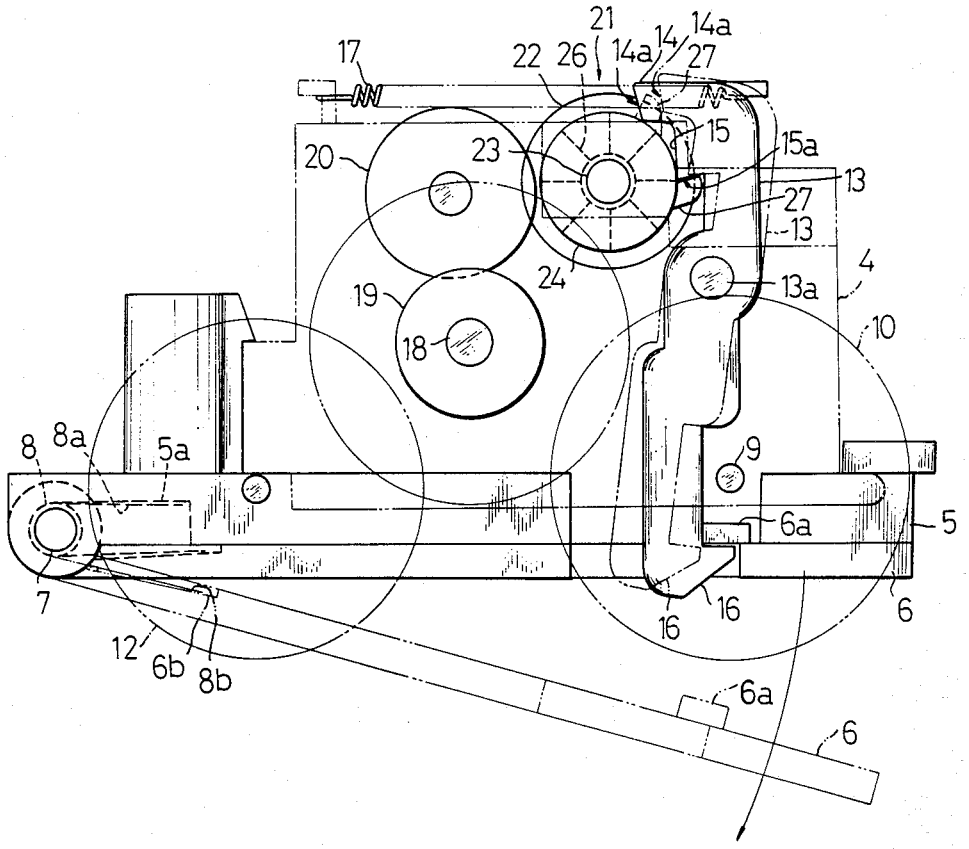
FIG. 4 illustrates the mechanism related to the forward somersaulting action.

A running toy 1 according to the invention includes, as shown in FIG. 1, a housing shell 2 having a configuration which simulates an airplane, for example, and a lower frame member 5 having a longitudinal axis connected to the housing shell 2 by a screw (not shown). A frame 4 with a motor assembly 3 housed therein is installed in the housing shell 2, the frame 4 is detachably mounted onto the lower frame member 5. A pivoting member 6 is attached to the under side of the lower frame member 5. As shown in FIG. 4, one end of the pivoting member 6 is pivotably supported by a shaft 7 carried horizontally at the lower front end of the lower frame member 5. The pivoting member 6 is subjected to a pivotal or biasing force in the clockwise direction (as viewed in FIG. 1) by means of a torsion coil spring 8 wound around the shaft 7, one end 8*a* of the spring 8 being retained by a groove 5*a* in the lower frame member 5, the other end 8*b* being retained by a groove 6*b* in the pivoting member 6. The pivoting member 6 is locked along the lower surface of the lower frame member 5 so that the free end of the pivoting member 6 points toward the rear of the lower frame member 5. Means for locking the pivoting member 6 and means for releasing the lock will be described later.

During the travelling or translational movement of the running toy 1, the pivoting member 6 is suddenly released from its locked state by the release means, described later, which is actuated in response to the action of the motor assembly 3 when it is operating, and pivots abruptly through 180° (to the position shown by the fragmentary lines) in the clockwise direction, as viewed in FIG. 1, by the force of the torsion coil spring 8. As the pivoting member 6 starts to pivot, the free end of the pivoting member 6 kicks against the support surface, and the pivotal force of the pivoting member 6 acts in a direction which lifts the rear end of the running toy 1 from the support surface. This causes the running toy 1 to jump and turn a somersault as shown in FIGS. 2(A) through 2(D) about an axis traverse to the longitudinal axis, the running toy 1 then lands on the support surface and continues to travel as before.

The mechanism related to the above somersaulting action of the running toy 1 will be described hereinafter in greater detail.

The motor assembly 3 is a spring-powered motor assembly with a power source (not shown) using a spring, for example. The frame 4 has a horizontal rear axle 9 carried rotatably at the rear part thereof. The rear axle 9 has rear wheels 10, driving wheels, attached to both ends thereof. The lower frame member 5 has a horizontal front axle 11 carried rotatably at the front part thereof. The front axle 11 has front wheels 12, running wheels, attached to both ends thereof.

The self-contained motor assembly 3 and the rear wheels 10 are linked to each other by a gear train (not shown), a one-way clutch mechanism and the rear axle 9 so that when the motor assembly 3 is operating, the power thereof is transmitted to the rear wheels 10, and when energy is being stored the wind-up force from the rear wheels 10 will be transmitted to the spring, etc., (not shown) in the motor assembly 3.

Figure 3:
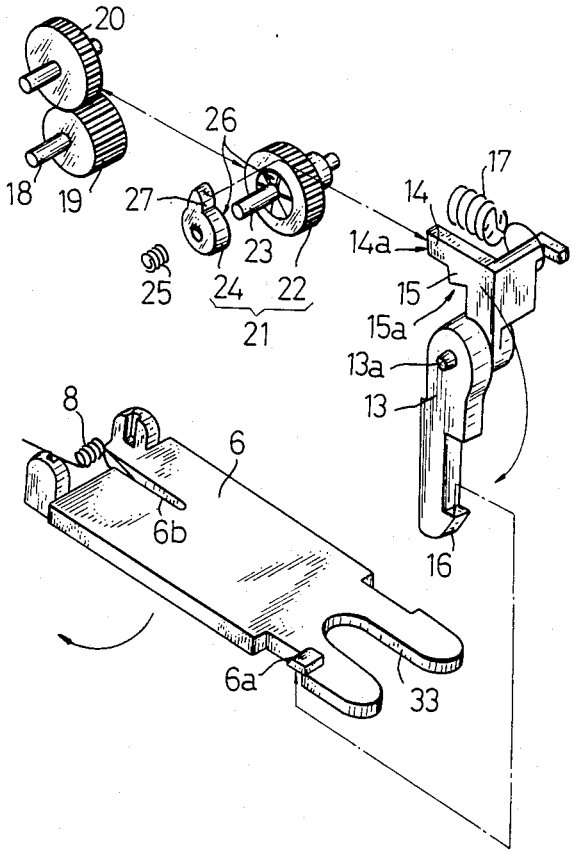
FIG. 3 is an exploded perspective view of the essential parts related to the somersaulting action.

The lock means for locking the pivoting member 6 along the lower surface of the lower frame member 5 and the release means releasing the lock effected by the lock means are as shown in FIGS. 3 and 4.

As an example of the lock means, a lock member 13 locking the pivoting member 6 along the lower surface of the lower frame member 5 is pivotally supported toward the rear of the frame 4, with an intermediate portion thereof pivotally supported on the frame 4 by a pin 13*a*. The upper end of the lock member 13 is formed as a cam follower having a first step 14 and a second step 15 formed at different levels. A hook 16 pointing toward the rear of the lower frame member 5 (as viewed in FIGS. 3 and 4) is formed at the lower end of the lock member 13. When the pivoting member 6 is positioned so as to be along the lower surface of the lower frame member 5, the hook 16 engages an engagement projection 6*a* provided on one side of the pivoting member 6 to lock the pivoting member 6 along the lower surface of the lower frame member 5. The lock member 13 is normally urged in the counterclockwise direction, as viewed in FIG. 4, by a tension coil spring 17 stretched between the upper front end of the frame 4 and the upper end of the lock member 13.

As an example of the release means, a cam gear 21 is provided which engages, through a gear 20, with a pinion gear 19 attached to a spring shaft 18 of the motor assembly 3. The cam gear 21 comprises a gear 22 secured to a rotary shaft 23 and in constant engagement with the gear 20, and a cam 24 loosely fitted onto the rotary shaft 23, the cam 24 being forced into resilient contact with a side surface of the gear 22 by a coiled spring 25. The cam 24 and the gear 22 are linked to each other by a one-way clutch mechanism 26 provided on the mutual contact surface thereof. The one-way clutch mechanism 26 is constituted by a known means which functions such that the cam 24 idles relative to the gear 22 in the counterclockwise direction, as viewed in FIGS. 3 and 4, but does not idle in the clockwise direction. The cam 24 has a cam projection 27 provided on the outer periphery thereof. When the cam 24 rotates clockwise, following the rotation of the gear 22 in the clockwise direction (as viewed in FIGS. 3 and 4) when the motor assembly 3 is operating the cam projection 27, as shown in FIG. 4, hits a front end surface 14*a* of the first step 14 to pivot the lock member 13 clockwise and release the locking of the pivoting member 6 by the hook 16. This state is shown by fragmentary lines in FIG. 4. On the other hand, when the gear 22 rotates counterclockwise to store energy, the cam 24 rotates counterclockwise, following the rotation of the gear 22. However, as shown by solid lines in FIG. 4, when the cam projection 27 hits against a lower end surface 15*a* of the second step 15, the rotation of the cam 24 is checked, and only the gear 22 rotates counterclockwise.

Figure 5A:
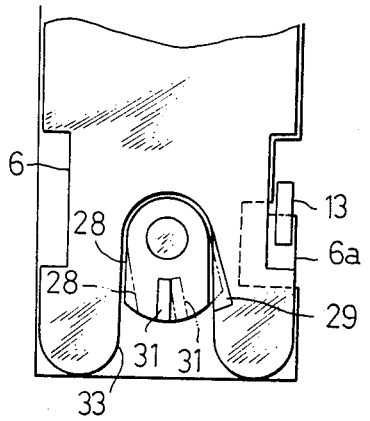
FIG. 5A is a fragmentary view of the base showing the action of a stopper locking a kicking member.
Figure 5B:
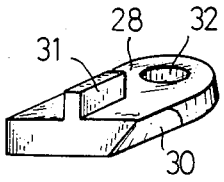
FIG. 5B is a perspective view of the whole of the stopper.
Figure 5C:
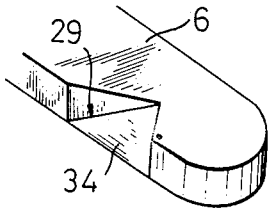
FIG. 5C is a fragmentary perspective view of the kicking member, in particular showing an engagement groove portion thereof.

Incidentally, as shown in FIGS. 5A through 5C, a stopper 28 for manual operation is attached to the lower rear of the lower frame member 5 to lock the pivoting member 6 when it is folded i.e., when the pivoting member 6 is held along the lower surface of the lower frame member 5. The stopper 28, as shown in FIG. 5B, has an inclined surface 30 on one side thereof which engages, in a surface-contact manner, an engagement groove 29 on the pivoting member 6 which will be described later. In addition, the stopper 28 has a projection 31 on one surface thereof for manual operation, together with a bearing hole 32 provided on the side close thereto. The stopper 28 is pivotally attached to the lower rear side of the lower frame member 5 about the bearing hole 32 as shown in FIG. 5A.

The pivoting member 6 has a U-shaped notch 33 formed at the free end thereof. The engagement groove 29 which is a notch of a substantially triangular shape is provided on an inner edge of the notch 33 which is also on the surface opposite to the surface against the lower frame member 5 when the pivoting member 6 is locked along the lower surface of the lower frame member 5, as shown in FIGS. 5A and 5C. The bottom surface of the engagement groove 29 is formed into an inclined surface 34 which matches the inclined surface 30 of the stopper 28.

As shown in FIG. 5A, the stopper 28 is attached pivotally to a position on the lower surface of the lower frame member 5 so that the stopper 28 meets the U-shaped notch 33 of the pivoting member 6 when it is locked. When the stopper 28 is parallel to the longitudinal axis of the lower frame member 5 as shown by the solid line in FIG. 5A, the locking of the pivoting member 6 is released. On the other hand, when the stopper 28 has pivoted counterclockwise as shown by the fragmentary line in the figure, and the inclined surface 30 of the stopper 28 is in contact with the inclined surface 34 of the engagement groove 29 of the pivoting member 6, the pivoting member 6 is locked. When the pivoting member 6 is held locked by the stopper 28, if the locking of the pivoting member 6 by the lock member 13 is released, the pivoting member 6 is kept locked and hence will not pivot.

The operation of the embodiment of the invention having the above construction will be described hereinafter.

First of all, the pivoting member 6 is folded so as to be in contact with the lower surface of the lower frame member 5 and be locked by the lock member 13, i.e., the hook 16 engages with the engaging projection 6*a*, and the locking of the pivoting member 6 by the stopper 28 is released. Then, as shown by the arrow P in FIG. 2(A), the running toy 1 is moved backward while the rear wheels 10 are in contact with a support surface 100 in order to wind up the spring (not shown) to store energy in the motor assembly 3. In this energy-storing operation, the cam 24 rotates counterclockwise, following the gear 22, but after the cam projection 27 hits the lower end surface 15*a* of the second step 15, the cam 24 will not rotate even if the gear 22 rotates. Accordingly, the reset position of the cam projection 27 is maintained constant, so that no breaking stress is generated in the cam projection 27.

Figure 2:
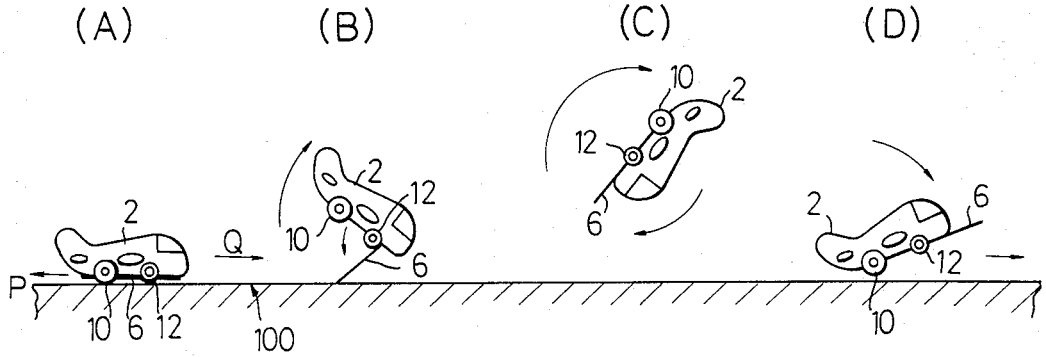
FIGS. 2(A) through 2(D) in combination illustrate the forward somersaulting action of the running toy.

Thereafter, when the running toy 1 is released so that it travels along the support surface 100 (as shown by the arrow Q in FIG. 2(A)), the cam 24 following the gear 22 through the one-way clutch mechanism 26 slowly rotates clockwise (as viewed in FIG. 4). Then, when the cam projection 27 moving from the position shown by the solid line in FIG. 4 reaches the position shown by the fragmentary line, the cam projection 27 pivots the lock member 13 clockwise (as viewed in FIG. 4) to release the locking of the pivoting member 6 by the lock member 13. When the locking of the pivoting member 6 is thus released, the pivoting member 6 suddenly pivots clockwise, as viewed in FIG. 4, due to the force of the torsion coil spring 8. During this pivoting of the pivoting member 6, from the moment the free end of the pivoting member 6 kicks against the support surface 100, as shown in FIG. 2(B), the running toy 1 is given both a clockwise rotational force and a jumping force to make it somersault and then land on the support surface 100 to continue its travelling as before, as shown in FIGS. 2(B) through 2(D).

On the other hand, to make the running toy 1 travel normally without somersaulting, the pivoting member 6 can be locked by the stopper 28 so that, even if the locking of the pivoting member 6 by the lock member 13 is released, the pivoting member 6 will not pivot. Therefore, the running toy 1 travels normally without somersaulting.

Although the running toy 1 turns one somersault in the above embodiment, it is also possible to design it so that the running toy 1 turns two or more somersaults, by regulating the force of the spring 8.

Figure 6:
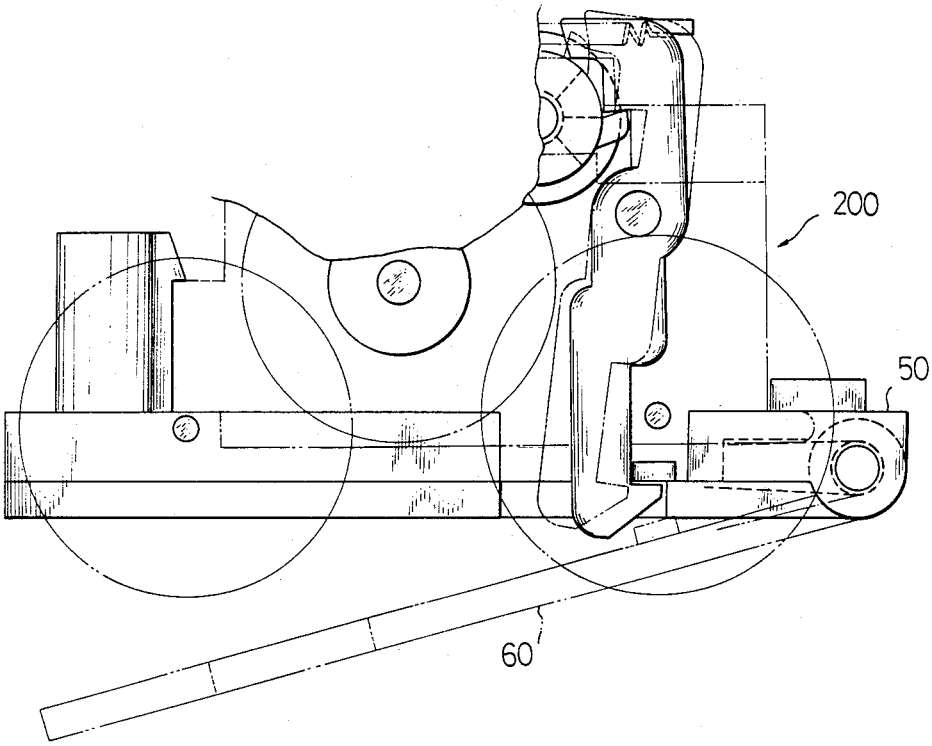
FIG. 6 illustrates essential parts of another example of the mechanism related to the somersaulting action.
Figure 7:
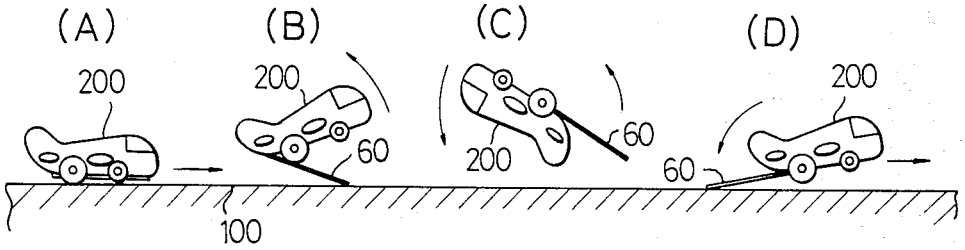
FIGS. 7(A) through 7(D) in combination illustrate a backward somersaulting action of the running toy effected by the mechanism shown in FIG. 6.

Moreover, although in the above embodiment, the pivot point of the pivoting member 6 is provided at the front end of the running toy 1 in order to make it turn a forward somersault, if the pivot point of a pivoting member 60 is provided at the rear end of a lower frame member 50 as shown by another embodiment of the invention illustrated in FIG. 6, a running toy 200 turns a backward somersault as shown in FIGS. 7(A) through 7(D). It must be noted that since the constructions of the other members and parts in this embodiment are the same as those in the first embodiment, a detailed description thereof is omitted.

It can thus be seen that the objects set forth above, among those other objects made apparent from the preceding description, are obtained efficiently and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A self-propelled toy vehicle capable of both a translational and predetermined rotational movement in a play action mode of operation, comprising:

a frame member having a longitudinal axis and a first and second end;

a front wheel assembly attached to the frame member;

a rear wheel assembly attached to the frame member;

a spring-powered motor assembly attached to the frame member and capable of operatively driving one of the front and rear wheel assemblies for translational movement of the vehicle across a support surface, the wheel assembly driven by the motor assembly also providing an energizing mode of operation to provide a wind-up force for storing energy in the motor assembly, and means for intentionally propelling the frame member above the support surface and rotating the frame member about an axis traverse to the longitudinal axis while above the support surface during a predetermined period of its translational movement including a pivoting member attached to and extending parallel to the longitudinal axis of the frame member's lower surface, means for biasing the pivoting member to rotate from an initial position adjacent a first end of the frame member parallel to the longitudinal axis to a final release position also parallel to the longitudinal axis adjacent the second end of the frame member, and a release means connected to the motor assembly for initiating the rotational movement, the release means including a gear driven by the motor assembly, a cam rotatably mounted and a one-way-clutch mechanism to permit the gear to move the cam in one direction only, whereby the motor assembly can store energy without activating the cam and can activate the cam in a running mode of operation, when the cam is activated the pivoting member can rotate the vehicle above the support surface and can assume a released position parallel to the longitudinal axis whereby the vehicle can continue its translational movement when it contacts the support surface.

2. The invention of claim 1 wherein the pivoting member is attached adjacent the front wheel assembly and is biased to rotate about its attachment point to urge the toy to perform a front somersault.

3. The invention of claim 1 wherein the pivoting member is attached adjacent the rear wheel assembly and is biased to rotate about its attachment point to urge the toy to perform a rear somersault.

4. The invention of claim 1 wherein the pivoting member can be further maintained in a biased lock position by a manual locking means.

5. The invention of claim 1 wherein the release means further includes a pivotally mounted lock member that is resiliently biased to a lock position and a cam mechanism driven by the motor assembly to cam the lock member to an open position.

* * * * *